US007895968B2

(12) United States Patent
Miura

(10) Patent No.: US 7,895,968 B2
(45) Date of Patent: Mar. 1, 2011

(54) LIQUID DROPLET EJECTION APPARATUS, METHOD FOR FORMING STRUCTURE, AND METHOD FOR MANUFACTURING ELECTRO-OPTIC DEVICE

(75) Inventor: Hirotsuna Miura, Fujimi-machi (JP)

(73) Assignee: Seiko Epson Corporation (JP)

( * ) Notice: Subject to any disclaimer, the term of this patent is extended or adjusted under 35 U.S.C. 154(b) by 1239 days.

(21) Appl. No.: 11/392,464

(22) Filed: Mar. 29, 2006

(65) Prior Publication Data

US 2006/0244808 A1 Nov. 2, 2006

(30) Foreign Application Priority Data

Mar. 30, 2005 (JP) ..... 2005-099941

(51) Int. Cl.
*B05C 11/00* (2006.01)

(52) U.S. Cl. ..... 118/668; 118/641; 118/642; 118/643

(58) Field of Classification Search ..... 118/668, 118/641, 642, 643; 347/51, 135
See application file for complete search history.

(56) References Cited

U.S. PATENT DOCUMENTS

2004/0226929 A1* 11/2004 Miura et al. ..... 219/121.85
2006/0003088 A1 1/2006 Kasuga et al.

FOREIGN PATENT DOCUMENTS

| | | |
|---|---|---|
| JP | 06-183034 | 7/1994 |
| JP | 2001-137765 | 5/2001 |
| JP | 2003-164789 | 6/2003 |
| JP | 2004-341114 | 12/2004 |

* cited by examiner

*Primary Examiner*—George R Koch, III
(74) *Attorney, Agent, or Firm*—Harness, Dickey & Pierce, P.L.C.

(57) ABSTRACT

A liquid droplet ejection apparatus includes: a liquid droplet ejection portion that ejects a liquid droplet containing a structure forming material onto a substrate; and drying means that dries the droplet on the substrate, thereby forming a structure made of the structure forming material. The drying means includes an energy outputting section that outputs energy onto the droplet on the substrate, thereby causing the structure forming material in the droplet to flow; and an energy profile controlling section controlling an energy profile of the energy output by the energy outputting section to be an energy profile that permits the structure forming material to flow such that the structure forming material is distributed in accordance with a structure profile of the structure to be formed. According to the liquid droplet ejection apparatus, a structure having a desired structure profile is obtained.

8 Claims, 9 Drawing Sheets

LIQUID DROPLET EJECTION APPARATUS, METHOD FOR FORMING STRUCTURE, AND METHOD FOR MANUFACTURING ELECTRO-OPTIC DEVICE

CROSS-REFERENCE TO RELATED APPLICATIONS

This application is based upon and claims the benefit of priority from prior Japanese Patent Application No. 2005-099941, filed on Mar. 30, 2005, the entire contents of which are incorporated herein by reference.

BACKGROUND

The present invention relates to a liquid droplet ejection apparatus, a method for forming a structure, and a method for manufacturing an electro-optic device.

Typically, a color filter substrate of a liquid crystal display is provided with a dot pattern consisting of a plurality of color films each having a dot like shape. The color films are provided through a liquid phase process. In the liquid phase process, liquid containing color film forming material is ejected onto color film forming sections, each of which is encompassed by a wall. The liquid is then dried in the color film forming sections so as to form the color films.

As described in Japanese Laid-Open Patent Publication No. 2004-341114, an inkjet method may be used as the liquid phase process. Specifically, according to the inkjet method, liquid is ejected onto each of color film forming sections as a microdroplet. The microdroplet is then dried to provide a color film.

The inkjet method reduces consumption of the liquid compared to other liquid phase processes including a spin coat method and a dispenser method. Further, the position of each color film is adjusted with improved accuracy. However, in the inkjet method, the distribution of concentrations of the color film forming material in the microdroplets varies depending on the viscosity of the microdroplets, the angle of contact with the color film forming section, and the concentration of the color film forming material in the process of drying the microdroplets. Therefore, the thickness of the dried color film cannot be controlled to have a desired thickness distribution.

SUMMARY

An advantage of some aspect of the invention is to provide a liquid droplet ejection apparatus and a structure forming method that form a structure having a desired structure profile and to provide a method for manufacturing an electro-optic device that has a color film or a light emission element having a desired structure profile.

To achieve the foregoing and other objectives and in accordance with the purpose of the present invention, according to a first aspect of the invention, a liquid droplet ejection apparatus is provided. The apparatus includes: a liquid droplet ejection portion that ejects a liquid droplet containing a structure forming material onto a substrate; and drying means that dries the droplet on the substrate, thereby forming a structure made of the structure forming material. The drying means includes: an energy outputting section that outputs energy onto the droplet on the substrate, thereby causing the structure forming material in the droplet to flow; and an energy profile controlling section controlling an energy profile of the energy output by the energy outputting section to be an energy profile that permits the structure forming material to flow such that the structure forming material is distributed in accordance with a structure profile of the structure to be formed.

According to a second aspect of the invention, a method for forming a structure on a substrate is provided. The method includes: ejecting a droplet containing a structure forming material onto the substrate; drying the droplet on the substrate, thereby forming a structure made of the structure forming material; and radiating energy onto the droplet on the substrate before or when drying the droplet, thereby permitting the structure forming material to flow such that the structure forming material is distributed in accordance with a structure profile of the structure to be formed. The radiated energy has an energy profile based on structure profile information related to the structure profile of the structure to be formed.

According to a third aspect of the invention, a method for manufacturing an electro-optic device is provided. The electro-optic device includes a substrate on which a color film is formed. The method includes forming the color film on the substrate by the above method for forming a structure on a substrate.

According to a fourth aspect of the invention, another method for manufacturing an electro-optic device is provided. The electro-optic device includes a substrate on which a light emission element is formed. The method includes forming the light emission element on the substrate by the above method for forming a structure on a substrate.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DESCRIPTION OF EXEMPLARY EMBODIMENTS

One embodiment of the present invention will be described below according to FIGS. 1 to 10.

Figure 1:
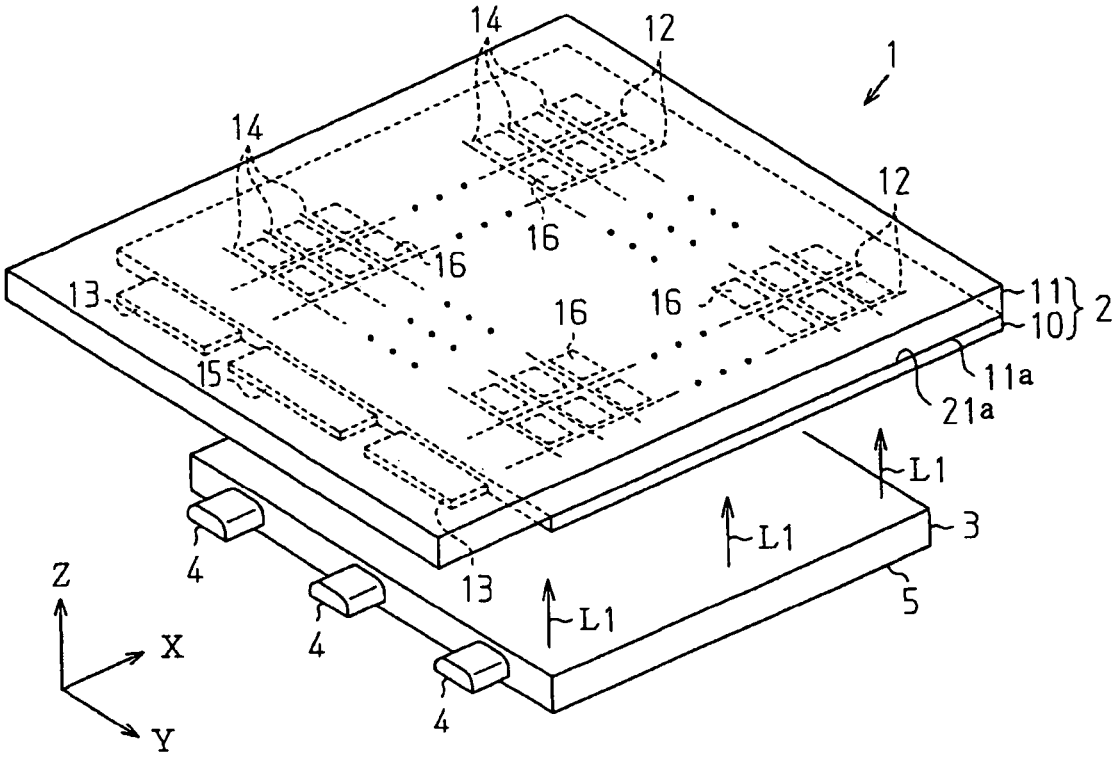
FIG. 1 is a perspective view showing a liquid crystal display according to one embodiment of the present invention.
Figure 2:
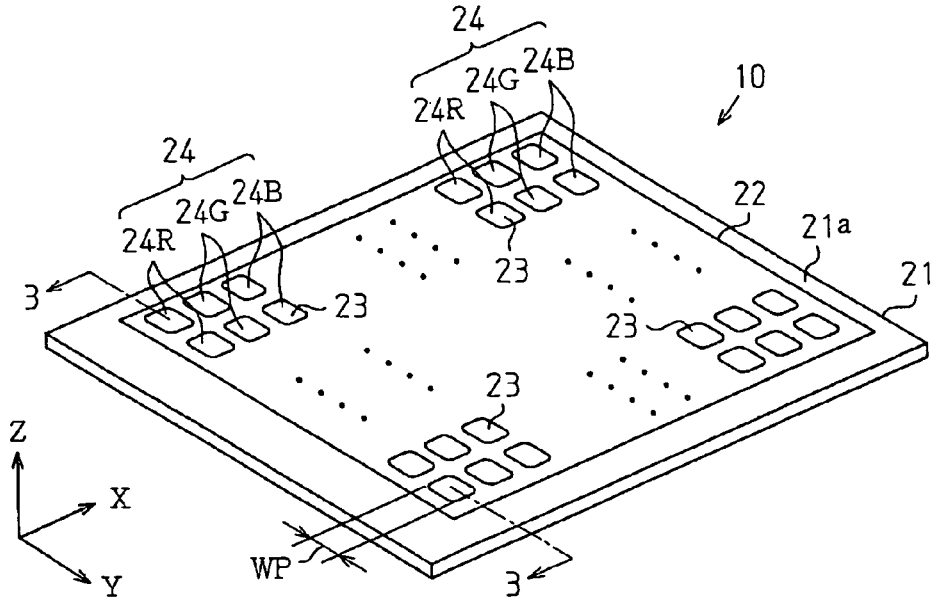
FIG. 2 is a perspective view showing a color filter substrate of the liquid crystal display of FIG. 1.
Figure 3:
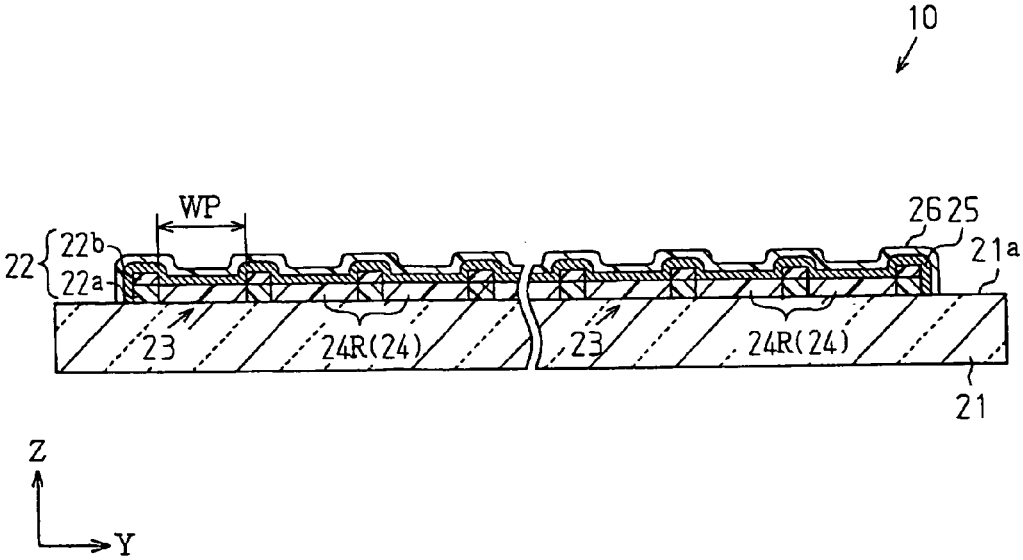
FIG. 3 is a cross-sectional view taken along the line 3-3 of FIG. 2.

First, a liquid crystal display 1 as an electro-optic device according to this embodiment will be described. FIG. 1 is a perspective view showing the liquid crystal display 1, FIG. 2 is a perspective view showing a color filter substrate 10 provided in the liquid crystal display 1, and FIG. 3 is a cross-sectional view taken along the line 3-3 of FIG. 2.

As shown in FIG. 1, the liquid crystal display 1 comprises a liquid crystal panel 2, and an illumination device 3 illuminating the liquid crystal panel 2 with an area light L1.

The illumination device 3 has light sources 4, which are, for example, LEDs, and a light guide 5. The light guide 5 produces the area light L1, which is illuminated onto the liquid crystal panel 2, from the light emitted by the light sources 4. The liquid crystal panel 2 has a color filter substrate 10 and an element substrate 11 that are bonded together. Non-illustrated liquid crystal molecules are sealed between the color filter substrate 10 and the element substrate 11. The position of the liquid crystal panel 2 is determined relative to the position of the illumination device 3 in such a manner that the color filter substrate 10 is located closer to the illumination device 3 than the element substrate 11.

The element substrate 11 is formed by a rectangular non-alkaline glass and includes an element forming surface 11*a*, which is a surface of the element substrate 11 facing the illumination device 3 (the color filter substrate 10). A plurality of scanning lines 12 are provided and equally spaced on the element forming surface 11*a*, extending in direction X. The scanning lines 12 are electrically connected to a scanning line driver circuit 13 arranged at an end of the element substrate 11. In correspondence with a scanning control signal of a control circuit (not shown), the scanning line driver circuit 13 generates a scanning signal for driving selected ones of the scanning lines 12 at predetermined timings.

A plurality of data lines 14 are formed and equally spaced on the element forming surface 11*a*, extending in direction Y perpendicular to each scanning line 12. The data lines 14 are electrically connected to a data line driver circuit 15, which is formed at the end of the element substrate 11. In correspondence with display data sent from a non-illustrated external device, the data line driver circuit 15 produces a data signal and outputs the data signal to a corresponding one of the data lines 14 at a predetermined timing.

A plurality of pixel areas 16 are formed on the element forming surface 11*a*. The pixel areas 16 are aligned in a matrix-like shape of "i" rows by "j" columns. Each of the pixel areas 16 is encompassed by an adjacent pair of the scanning lines 12 and an adjacent pair of the data lines 14 and is connected to the corresponding scanning line 12 and the associated data line 14. A non-illustrated control element formed by, for example, a TFT and a pixel electrode are formed in each pixel area 16. The pixel electrode is formed by a transparent conductive film formed of, for example, ITO. In other words, the liquid crystal display 1 is an active-matrix-type liquid crystal display that includes the control element such as a TFT.

An non-illustrated alignment film is provided under the scanning lines 12, the data lines 14, and the pixel areas 16 (on a side facing the color filter substrate 10) to cover the element forming surface 11*a* entirely. The alignment film is subjected to alignment treatment such as rubbing treatment. The alignment film thus orientates the liquid crystal molecules in the vicinity of the alignment film in a certain direction.

As shown in FIG. 2, the color filter substrate 10 includes the rectangular transparent glass substrate 21 formed of non-alkaline glass.

As shown in FIG. 3, the color filter substrate 10 includes a color film forming surface 21*a*, which is a surface of the color filter substrate 10 that faces the element substrate 11. A light shielding layer 22*a* is provided on the color film forming surface 21*a*. The light shielding layer 22*a* is formed of resin containing light shielding material such as chrome and carbon black. The light shielding layer 22*a* has a grid-like shape corresponding to the scanning lines 12 and the data lines 14. A liquid repelling layer 22*b* is defined on the light shielding layer 22*a*. The liquid repelling layer 22*b* is a resin layer formed of fluorinated resin that repels liquid droplets FD (see FIG. 6), which will be later described. The liquid repelling layer 22*b* prevents the droplets FD from protruding from corresponding color film forming areas 23, which also will be explained later.

Referring to FIG. 2, a grid-like wall 22 is formed on a substantially entire portion of the color film forming surface 21*a* by the light shielding layer 22*a* and the liquid repelling layer 22*b*. The color film forming areas 23, which are portions of the color film forming surface 21*a* that are encompassed by the corresponding portions of the wall 22, are aligned in a matrix-like shape of "i" rows by "j" columns. Each of the color film forming areas 23 is opposed to the corresponding one of the pixel areas 16. In this embodiment, each of the color film forming areas 23 has a substantially square in which the length in a direction Y consists of a pixel width WP.

In this embodiment, the columns of the color film forming areas 23 are sequentially numbered in a direction opposite to direction Y as a first column to an "i"th column.

As shown in FIG. 3, a color film 24 having a dot like shape is formed in each of the color film forming areas 23. The color films 24 allow light L1 from the illumination device 3 to pass therethrough to be converted into colored light. The color films 24 are arranged to form a predetermined dot pattern. The color films 24 include red films 24R, green films 24G, and blue films 24B, which are provided in a manner alternating in this order along direction X of FIG. 2.

The color films 24 are made of a color film forming material (e.g. organic pigments) as a structure forming material. The color films 24 are provided using a liquid droplet ejection apparatus 30 (see FIG. 4), which will be described later. Specifically, microdroplets Fb (see FIG. 6) containing the color film forming material are ejected onto the corresponding color film forming areas 23 through ejection nozzle holes N (see FIG. 5). The microdroplets Fb on the color film forming surface 21*a* are agitated and dried by application of a laser beam B as energy, which will be described later. The color films 24 are thus provided.

The thickness distribution as a structure profile of the color films 24 are made uniform within the corresponding color film forming areas 23 and uniform between the color film forming areas 23 by a planarization sequence, which will be described later.

Referring to FIG. 3, an opposing electrode 25 is formed on the color films 24. The opposing electrode 25 opposes the pixel electrodes of the element substrate 11. A predetermined common potential is provided to the opposing electrode 25. An alignment film 26 is defined on the opposing electrode 25 and orientates the liquid crystal molecules in the vicinity of the opposing electrode 25 in a certain direction.

In accordance with line-sequential scanning, the scanning line driver circuit 13 sequentially drives the scanning lines 12 one by one. This sequentially activates the control elements of the pixel areas 16. Activation of each control element is maintained only for the time corresponding to the time in which the associated scanning line 12 is activated. In correspondence with the activated control element, the data signal generated by the data line driver circuit 15 is sent to the associated pixel electrode through the corresponding data line 14 and the control element. The orientation of the liquid crystal molecules is thus held in a state in which the light L1 from the illumination device 3 is modulated in correspondence with the difference between the potential of the pixel electrode of the element substrate 11 and the potential of the opposing electrode 25 of the color filter substrate 10. Accordingly, by selectively passing the modulated light L1 through a non-illustrated deflection plate, the liquid crystal panel 2 displays a desired full-color image through the color filter substrate 10.

Figure 4:
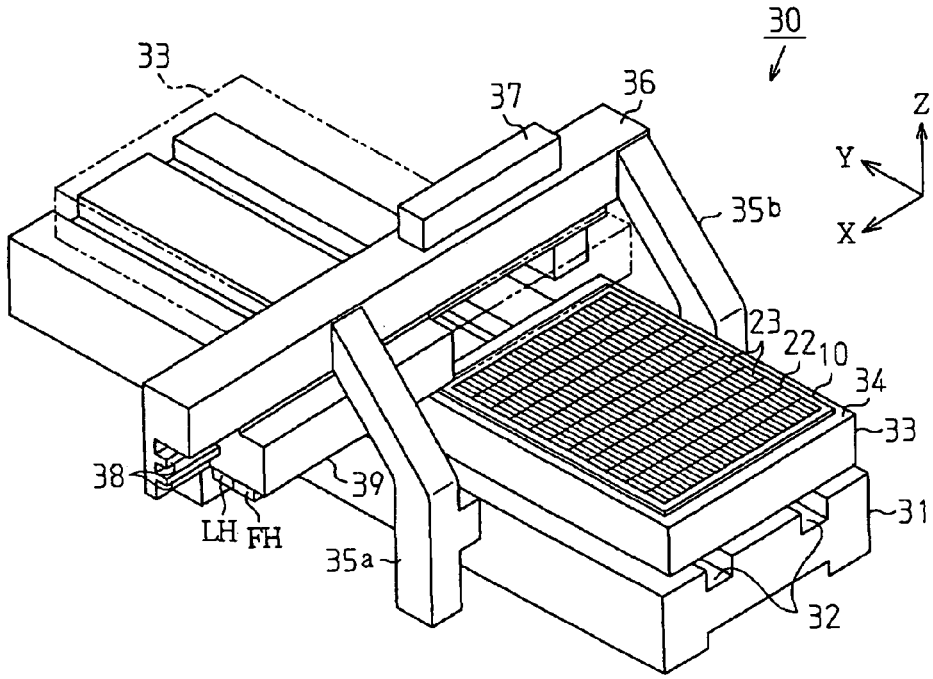
FIG. 4 is a perspective view schematically showing a liquid droplet ejection apparatus according to the embodiment.

The liquid droplet ejection apparatus 30 used for forming the color films 24 will hereafter be described. FIG. 4 is a perspective view showing the liquid droplet ejection apparatus 30.

As shown in FIG. 4, the liquid droplet ejection apparatus 30 includes a parallelepiped base 31. The base 31 is provided in such a manner that the longitudinal direction of the base 31 extends in direction Y with the color filter substrate 10 mounted on a substrate stage 33, which will be described later. A pair of guide grooves 32 are defined in the upper surface of the base 31 and extend throughout the base 31 in direction Y. The substrate stage 33 having a non-illustrated linear movement mechanism corresponding to the guide grooves 32 is secured to the upper surface of the base 31. The linear movement mechanism of the substrate stage 33 is a threaded type linear movement mechanism having, for example, a threaded shaft (a drive shaft) extending along the guide grooves 32 in direction Y and a ball nut that is engaged with the threaded shaft. The drive shaft of the linear movement mechanism is connected to a y-axis motor MY (see FIG. 9), which is a stepping motor. The y-axis motor MY rotates in a forward or reverse direction in response to a drive signal corresponding to a predetermined number of steps. This advances or retreats (moves) the substrate stage 33 at a predetermined transport speed Vy along direction Y by an amount corresponding to the number of steps.

In this embodiment, as shown in FIG. 4, when the base 31 is located at a foremost position in direction Y (as indicated by the solid lines in FIG. 4), it is defined that the base 31 is arranged at a proceed position. When the base 31 is located at a rearmost position in direction Y (as indicated by the double-dotted broken lines in FIG. 4), it is defined that the base 31 is arranged at a return position.

A suction type chuck mechanism (not shown) is provided on a mounting surface 34, which is the upper surface of the substrate stage 33. When the color filter substrate 10 is mounted on the mounting surface 34 with the surface having the color film forming areas 23 facing upward, the color filter substrate 10 is positioned with respect to the mounting surface 34. The substrate stage 33 is then advanced at the transport speed Vy in direction Y in such a manner that the color film forming areas 23 move at the transport speed Vy in direction Y.

A pair of supports 35*a*, 35*b* are provided at opposing sides of the base 31 in direction X. The supports 35*a*, 35*b* support a guide member 36 extending in direction X. The longitudinal dimension of the guide member 36 is greater than the dimension of the substrate stage 33 in direction X. An end of the guide member 36 is projected beyond the support 35*a*. A non-illustrated maintenance unit is arranged immediately below the projected end of the guide member 36. The maintenance unit wipes off a nozzle surface 41*a* (see FIG. 5) of a liquid droplet ejection head FH, which will be explained later, thus cleansing the nozzle surface 41*a*.

A tank 37 is located on the guide member 36 and retains color film forming liquids F (see FIG. 6) of the three colors. The color film forming liquid F of each of the colors is prepared by dispersing color film forming material (which is, for example, tetradecane) of the corresponding color in dispersion medium. The tank supplies color film forming liquids F to the ejection head FH, which will be described later.

As shown in FIG. 4, a carriage 39 is secured to the bottom surface of the guide member 36. The carriage 39 has a non-illustrated linear movement mechanism provided in correspondence with a pair of upper and lower guide rails 38, which extend in direction X. The linear movement mechanism of the carriage 39 is formed by a threaded type linear movement mechanism having, for example, a threaded shaft (a drive shaft) extending along the guide rails 38 in direction Y and a ball nut engaged with the threaded shaft. The drive shaft of the linear movement mechanism is connected to an x-axis motor MX (see FIG. 9), which is a stepping motor. The x-axis motor MX rotates in a forward or reverse direction in response to a drive signal corresponding to a predetermined number of steps. This advances or retreats (moves) the carriage 39 along direction X by an amount corresponding to the number of the steps.

In this embodiment, referring to FIG. 4, when the carriage 39 is located at a position closest to the support 35*a* (as indicated by the solid lines in FIG. 4), or when the carriage 39 is located at a foremost position in direction X, it is defined that the carriage 39 is arranged at a proceed position. When the carriage 39 is located at a position closest to the support 35*b* (as indicated by the double-dotted broken lines in FIG. 4), or when the carriage 39 is located at a rearmost position in direction X, it is defined that the carriage 39 is arranged at a return position.

Figure 5:
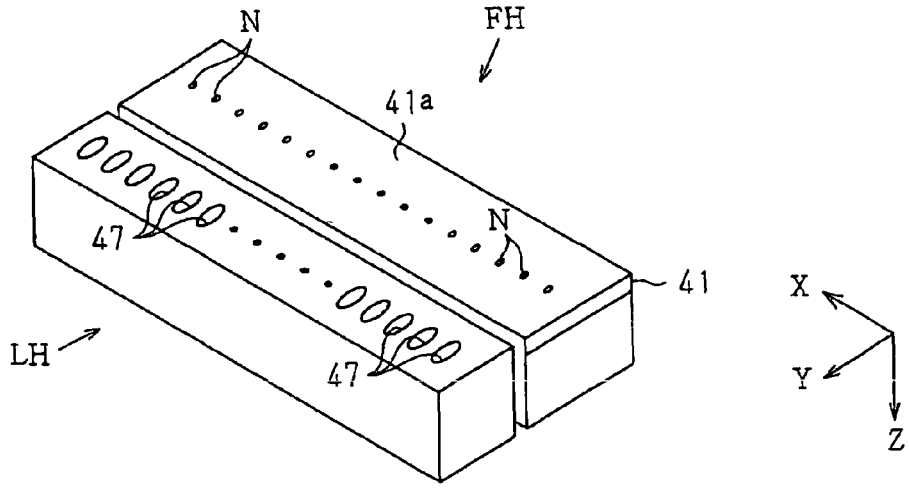
FIG. 5 is a perspective view schematically showing a liquid droplet ejection head of the liquid droplet ejection apparatus of FIG. 4.
Figure 6:
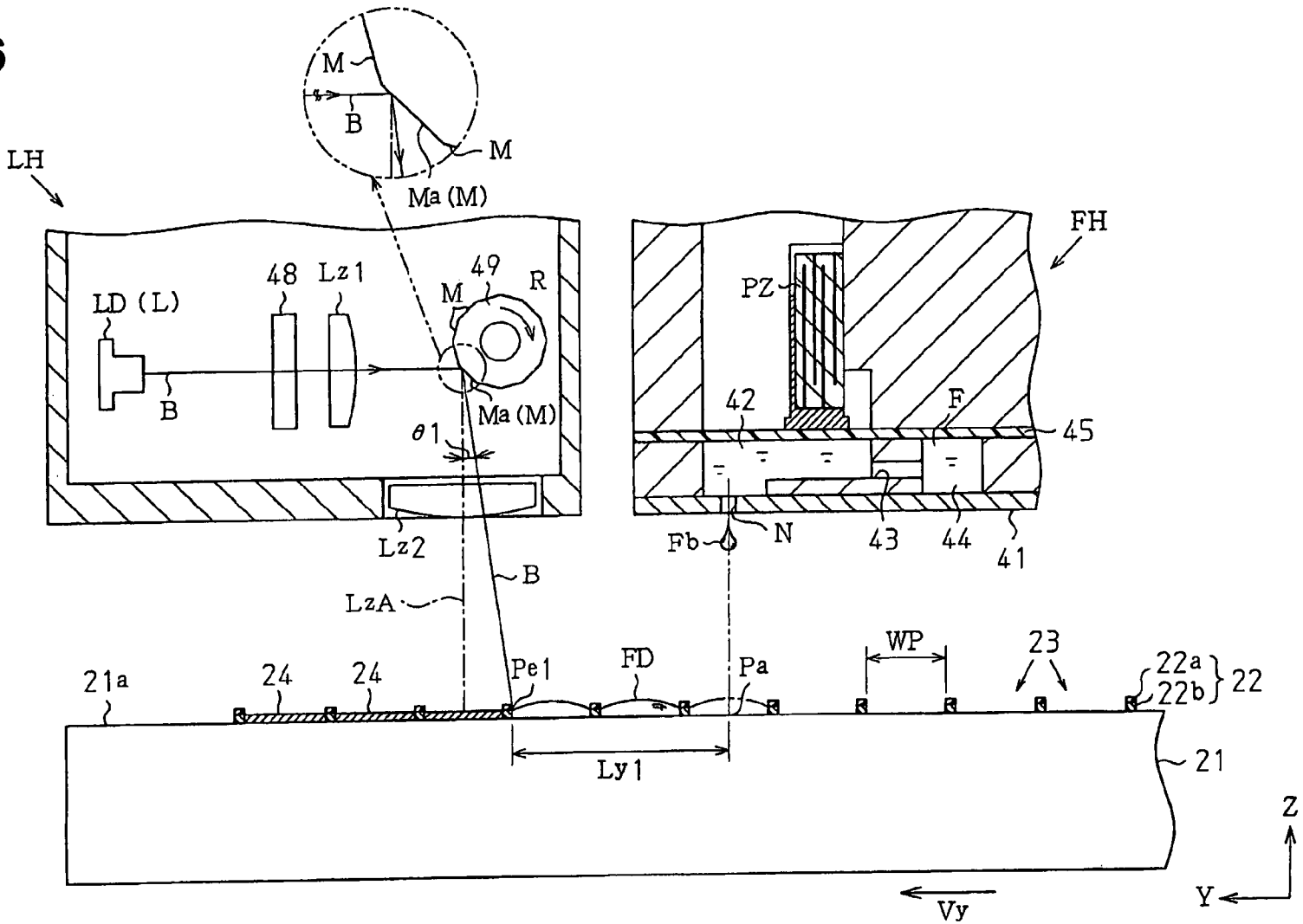
FIG. 6 is a cross-sectional view for explaining the liquid droplet ejection head of FIG. 5.

As shown in FIG. 4, the liquid droplet ejection head FH is arranged below the carriage 39 and extends in direction X. The ejection head FH forms a liquid droplet ejecting portion of the three colors (red, green, and blue) corresponding to the color films 24R, 24G, 24B. FIG. 5 is a perspective view showing the ejection head FH with the bottom surface of the ejection head FH (i.e. the surface of the ejection head FH that is opposed to the substrate stage 33) facing upward. FIG. 6 is a cross-sectional view showing the interior of a main portion of the ejection head FH.

As shown in FIG. 5, a nozzle plate 41 is provided on the bottom surface of the ejection head FH. The bottom surface of the nozzle plate 41 (the nozzle surface 41*a*) includes 180 nozzle holes N that eject the microdroplets Fb, as will be later explained. The nozzle holes N extend through the nozzle plate 41 and are aligned in direction X and equally spaced. The pitch of the nozzle holes N is equal to the pitch of the color film forming areas 23. The nozzle holes N oppose the corresponding color film forming areas 23 when the color filter substrate 10 is (the color film forming areas 23 are) linearly reciprocated along direction Y. Each of the nozzle holes N extends perpendicular to the nozzle surface 41*a* and perpendicular to the surface of the color filter substrate 10 having the color film forming areas 23. The microdroplets Fb (see FIG. 6) ejected through the nozzle holes N thus travel along direction Z.

As shown in FIG. 6, cavities 42, or pressure chambers, are defined in the ejection head FH above the corresponding nozzle holes N direction Z. Each cavity 42 communicates with the tank 37 through a corresponding communication bore 43 and a supply line 44, which is provided commonly for the communication bores 43. The color film forming liquid F of the corresponding color is thus introduced from the tank 37 into each cavity 42. The cavity 42 then provides the color film forming liquid F to the associated nozzle hole N.

An oscillation plate 45 is arranged above the cavities 42. The oscillation plate 45 is capable of oscillating in a vertical direction. Through such oscillation, oscillation plate 45 selectively increases and decreases the volume of each cavity 42. One hundred and eighty piezoelectric elements PZ are arranged above the oscillation plates 45 and in correspondence with the nozzle holes N. Each of the piezoelectric elements PZ receives a corresponding drive signal, which is a corresponding piezoelectric element drive signal COM1 (see FIG. 9). In response to the drive signal, the piezoelectric element PZ contracts and extends in the vertical direction, thus oscillating the associated oscillation plate 45 in the vertical direction.

Through such contraction and extension, the piezoelectric element PZ increases and then decreases the volume of the corresponding cavity 42. The color film forming liquid F is thus ejected from the corresponding nozzle hole N as the microdroplet Fb by an amount corresponding to the decrease of the volume of the cavity 42. The microdroplet Fb is then received by the color film forming surface 21*a* located immediately below the nozzle hole N.

In this embodiment, a position at which the microdroplet Fb is received by the corresponding color film forming area 23 is defined as a target ejecting position Pa. In this embodiment, a plurality of microdroplets Fb are ejected onto each target ejecting position Pa to form a droplet FD of the united microdroplets. Fb in each color film forming area 23.

As shown in FIG. 4, a laser head LH, which is drying means (a drier), is provided below the carriage 39 and forward from the ejection head FH in direction Y. With reference to FIG. 5, the bottom surface of the laser head LH includes 180 radiation ports 47, which are provided in correspondence with the nozzle holes N at positions forward from the nozzle holes N in direction Y.

As shown in FIG. 6, a semiconductor laser array LD having a plurality of semiconductor lasers L is provided in the laser head LH. The semiconductor lasers L are arranged in correspondence with the radiation ports 47. Each of the semiconductor lasers L receives a drive signal for driving the semiconductor laser L, which is a laser drive signal COM2 (see FIG. 9). In response to the drive signal, the semiconductor laser L radiates a laser beam B in wavelength region allowing the color film forming liquid F (droplet FD) to be agitated and dried.

In the laser head LH, a phase modulating portion 48 forming an energy profile controlling section, a cylindrical lens Lz1, and a polygon mirror 49 and a scanning lens Lz2 forming an energy scanning section are provided near each of the semiconductor lasers L at a position corresponding to the corresponding radiation port 47. The phase modulating portion 48, the cylindrical lens Lz1, the polygon mirror 49 and the scanning lens Lz2 are provided in order from the position closest to the corresponding semiconductor laser L.

Each phase modulating portion 48 is constituted by a plurality of diffractive elements which are mechanically or electrically driven, or a spatial light modulator such as liquid crystals, and receives a signal for driving the phase modulating portion 48 (phase modulating portion drive signal COM3, see FIG. 9) to subject the laser beam B from the semiconductor laser L to preset predetermined phase modulation. Specifically, each phase modulating portion 48 carries out phase modulation corresponding to each piece of beam profile forming information BPI based on a plurality of pieces of beam profile forming information BPI (first agitation profile forming information BPI1 and second agitation profile forming information BPI2). Each phase modulating portion 48 switches the phase modulation in timing based on a beam profile sequence BPS as energy profile information described later.

The cylindrical lens Lz1 has curvature only in direction Z. The cylindrical lens Lz1 performs "optical face tangle error correction" for the polygon mirror 49. The cylindrical lens Lz1 guides the laser beam B to the polygon mirror 49. The polygon mirror 49 has thirty-six reflective surfaces M, which define a regular triacontakaihexagon (a regular thirty-six-sided polygon) as a whole. The reflective surfaces M are rotated by a polygon motor MP (see FIG. 9) in a direction indicated by arrow R of FIG. 6. Every time the rotational angle θp of the polygon mirror 49 is advanced at 10 degrees in direction R, the reflective surface M that receives the laser beam B is switched from a preceding reflective surface M to a following reflective surface M. The scanning lens Lz2 is defined by an f-theta lens that keeps constant the scanning speed on the color film forming surface 21*a* of the laser beam B reflected and deflected by the polygon mirror 49.

In FIG. 6, the laser beam B from the cylindrical lens Lz1 is received by the end of the reflective surface M (Ma) of the polygon mirror 49 located forward in direction R. The deflection angle of the laser beam B, which is reflected and deflected by the polygon mirror 49, is a deflection angle θ1 (in this embodiment, five degrees). In this embodiment, in the state of FIG. 6, it is defined the rotational angle θp of the polygon mirror 49 is zero degrees.

When the laser drive signal COM2 and the phase modulating portion drive signal COM3 are supplied to the semiconductor laser L and the phase modulating portion 48 when the rotation angle θp of the polygon mirror 49 is zero degrees, the laser beam B from the semiconductor laser L is subjected to phase modulation by the phase modulating portion 48. When the laser beam B subjected to phase modulation is introduced into the cylindrical lens Lz1, the cylindrical lens Lz1 adjusts the optical axis of the laser beams B in relation to a direction orthogonally crossing the sheet face and guides the laser beam B to the polygon mirror 49. The polygon mirror 49 into which the laser beam B has been introduced reflects and deflects the laser beam B in the direction of the deflection angle θ1 in relation to the optical axis LzA by the reflection surface Ma and guides the laser beam B onto the color film forming surface 21*a* via the scanning lens Lz2. The laser beam B guided to the color film forming surface 21*a* forms a laser beam cross section (beam spot) having a certain intensity distribution (beam profile as an energy profile) on the color film forming surface 21*a* in response to phase modulation of the phase modulating portion 48. When the droplet FD deposited at the target ejecting position Pa is transferred in direction Y at a transport speed Vy and enters the beam spot, the droplet FD is irradiated with the laser beam B of a predetermined beam profile deflected and reflected by the reflection surface Ma.

In this embodiment, a position at which the beam spot is formed when the rotation angle θp is zero degrees is referred to as a radiation start position Pe1. In this embodiment, as shown in FIG. 6, a distance between the radiation start position Pe1 and the target ejecting position Pa is an irradiation standby distance Ly1, and time after ejection of the microdroplet Fb is started until the microdroplet Fb (droplet FD) arrives at the radiation start position Pe1 is referred to as standby time T.

Figure 7:
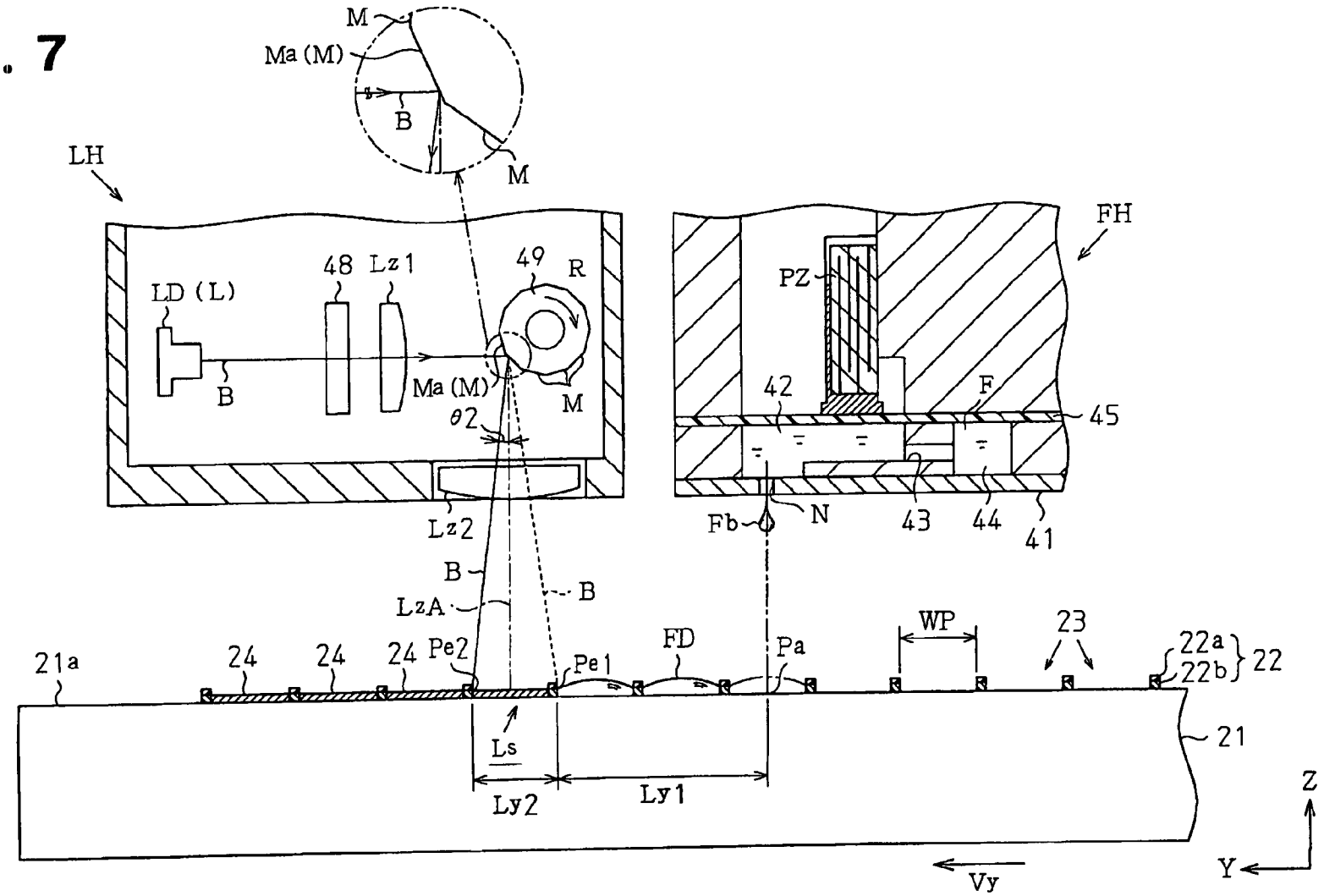
FIG. 7 is another cross-sectional view for explaining the liquid droplet ejection head of FIG. 5.

Subsequently, the polygon mirror 49 rotates in the direction R, and when its rotation angle θp becomes substantially ten degrees, the polygon mirror 49 deflects and reflects the laser beam B in the direction of a deflection angle θ2 (−5° in this embodiment) in relation to the optical axis LzA by the rear end of the reflection surface Ma with respect to direction R, and guides the laser beam onto the color film forming surface 21*a* via the scanning lens Lz2 as shown in FIG. 7. The laser beam B guided to the color film forming surface 21*a* forms a beam spot of a predetermined beam profile on the color film forming surface 21*a* in response to phase modulation of the phase modulating portion 48.

In this embodiment, a position at which the beam spot is formed when the rotation angle θp is substantially ten degrees is referred to as an radiation end position Pe2, and a region between the radiation end position Pe2 and the radiation start position Pe1 is referred to as a scanning zone Ls. The width (scanning width Ly2) of the scanning zone Ls in direction Y is set to a width equal to the formation pitch of the color film forming areas 23 along direction Y.

That is, the laser head LH is configured to scan the laser beam B (repeats movement from the radiation start position Pe1 to the radiation end position Pe2) in a predetermined cycle (scanning cycle=scanning width Ly2/transport speed Vy) along direction Y with the color film forming area 23 as a unit by deflection and reflection by the polygon mirror 49.

The rotation speed of the polygon motor MP (see FIG. 9) is set to a speed such that the laser beam B is scanned only once while each color film forming area 23 is conveyed from the radiation start position Pe1 to the radiation end position Pe2. That is, each droplet FD passing through the scanning zone Ls is irradiated with the laser beam B with its relative radiating position made stationary by scanning of the laser beam B.

The laser head LH (semiconductor laser L and phase modulating portion 48) receives the laser drive signal COM2 and the phase modulating portion drive signal COM3 to form a beam profile corresponding to the phase modulating portion drive signal COM3 with in a cycle synchronous with the scanning cycle of the laser beam B.

Figure 8A:
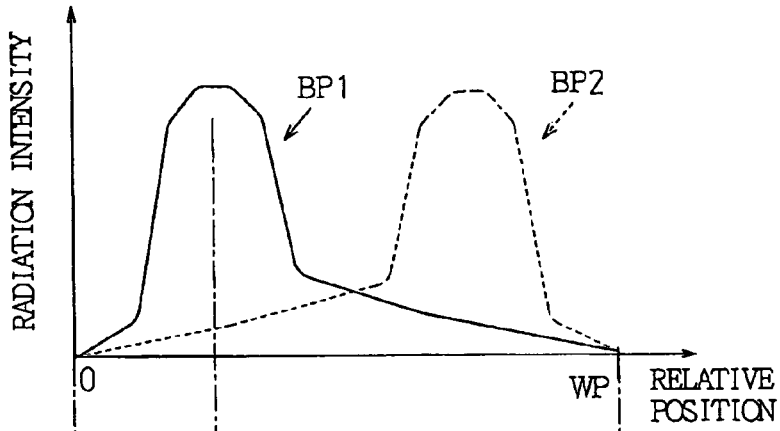
FIGS. 8A, 8B, and 8C are diagrams for explaining a beam profile for a color film forming area according to the embodiment.
Figure 8B:
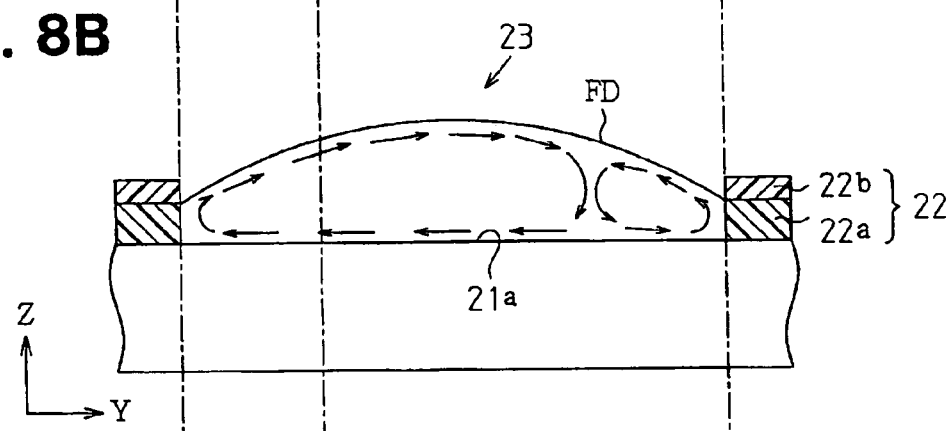
Figure 8C:
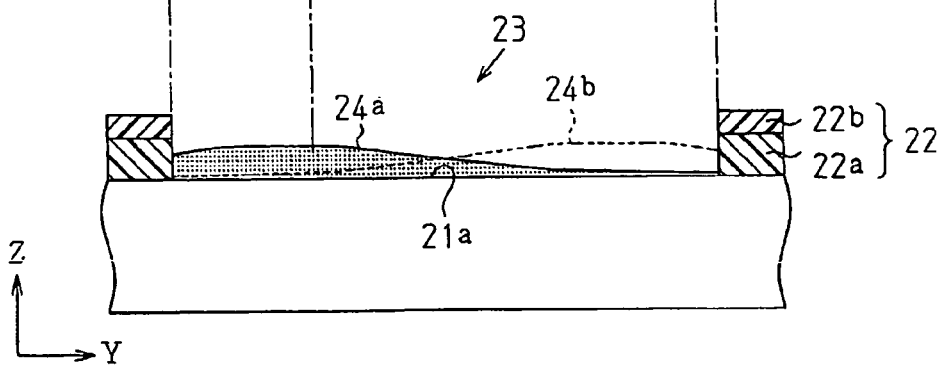

A beam profile as an energy profile in this embodiment will now be described below. FIGS. 8A, 8B and 8C and FIG. 9 are diagrams for explaining the beam profile. In FIG. 8A, the abscissa represents relative positions along direction Y where the rear end of the beam spot with respect to direction Y is a base point (zero point), and the ordinate represents irradiation intensities of the laser beam. FIG. 8B is a diagram for explaining the state of the droplet FD corresponding to the beam profile shown with the solid line of FIG. 8A. FIG. 8C shows a thickness distribution of the color film 24 corresponding to the beam profile of FIG. 8A.

The laser head LH forms a beam profile (first agitation profile BP1) having a sharp peak of radiation intensity only in a rear portion with respect to direction Y of the color film forming area 23 as shown with the solid line in FIG. 8A, based on the beam profile forming information BPI (first agitation profile forming information BPI1).

The first agitation profile BP1 has the maximum value of its radiation intensity set to an intensity for sufficiently inhibiting evaporation of the color film forming material and the dispersion medium and inducing thermal convection of the color film forming material and the dispersion medium in the corresponding droplet FD. The first agitation profile BP1 is formed with a substantially same intensity over the entire width of the color film forming area 23 in direction X along a direction vertical to the sheet face of FIG. 8A, i.e. direction X.

When the droplet FD formed on the color film forming area 23 is irradiated with the laser beam B of the first agitation profile BP1, thermal convection of the color film forming material and the dispersion medium is induced in the droplet FD in a front portion and in a rear portion with respect to direction Y as shown with arrows of FIG. 8B. The extent of thermal convection increases on a side on which light energy is supplied, i.e. on a side of the peak position (a rear portion with respect to direction Y) of the first agitation profile BP1, and decreases in a front portion with respect to direction Y. Accordingly, in the color film forming area 23 irradiated with the laser beam B, the color film forming material flows so as to shift toward a rear portion with respect to direction Y (agitated).

In the meantime, the first agitation profile BP1 is formed by the laser beam B having an intensity to sufficiently inhibit evaporation of the color film forming material and the dispersion medium, and therefore the droplet FD has the hardening of its color film forming material inhibited and its flowability maintained.

The laser beam B of the first agitation profile BP1 is applied, a beam profile (drying profile) to uniformly evaporate the dispersion medium is then formed, and the laser beam B of the drying profile is applied to the droplet FD. Then, a color film (first color film 24*a*) having a structure profile (thickness distribution) in which the thickness is substantially uniform on a side on which the color film material shifts, i.e. in a rear portion with respect to direction Y of the color film forming area 23, and the thickness gradually decreases from the central position of the color film forming area 23 toward a front edge with respect to direction Y as shown with the solid line of FIG. 8C is formed.

The laser head LH forms a beam profile (second agitation profile BP2) having a sharp peak of radiation intensity only in a front portion with respect to direction Y of the color film forming area 23 as shown with the dashed line in FIG. 8A, based on the beam profile forming information BPI (second agitation profile forming information BPI2). That is, the laser head LH forms a beam profile with the first agitation profile BP1 mirror-inversed at the central position of the color film forming area 23, based on the second agitation profile forming information BPI2.

The second agitation profile BP2 has the maximum value of its radiation intensity set to an intensity for sufficiently inhibiting evaporation of the color film forming material and the dispersion medium and inducing thermal convection of the color film forming material and the dispersion medium in the corresponding droplet FD. The second agitation profile BP2 is formed with a substantially same intensity over the entire width of the color film forming area 23 in direction X along a direction vertical to the sheet face of FIG. 8A, i.e. direction X.

The laser beam B of the second agitation profile BP2 is applied, a beam profile (drying profile) to uniformly evaporate the dispersion medium is then formed, and the laser beam B of the drying profile is applied to the droplet FD. Then, a color film (second color film 24*b*) having a thickness distribution in which the thickness is substantially uniform in a front portion with respect to direction Y of the color film forming area 23 and the thickness gradually decreases from the central position of the color film forming area 23 toward rear edge with respect to direction Y as shown with the dashed line of FIG. 5C is formed.

In this embodiment, the planarization sequence is formed based on the aforementioned three types of beam profiles (first agitation profile BP1, second agitation profile BP2, and drying profile). That is, the planarization sequence forms the first agitation profile BP1 for a predetermined time (first agitation time), subsequently forms the second agitation profile BP2 for a predetermined time (second agitation time), and finally forms the drying profile for a predetermined time (drying time). The total time of the first agitation time, second agitation time and drying time is set to a time shorter than the scanning cycle of the laser beam B (the scanning time=scanning width Ly2/transport speed Vy).

When the droplet FD formed on the color film forming area 23 is irradiated with the laser beam B based on the planarization sequence, the color film forming material is substantially uniformly dispersed from the rearmost end in direction Y to the foremost end in direction Y in the droplet. The color film 24 having a uniform thickness distribution is formed on the color film forming area 23.

The electric configuration of the liquid droplet ejection apparatus 30 configured as described above will now be described according to FIG. 9.

Figure 9:
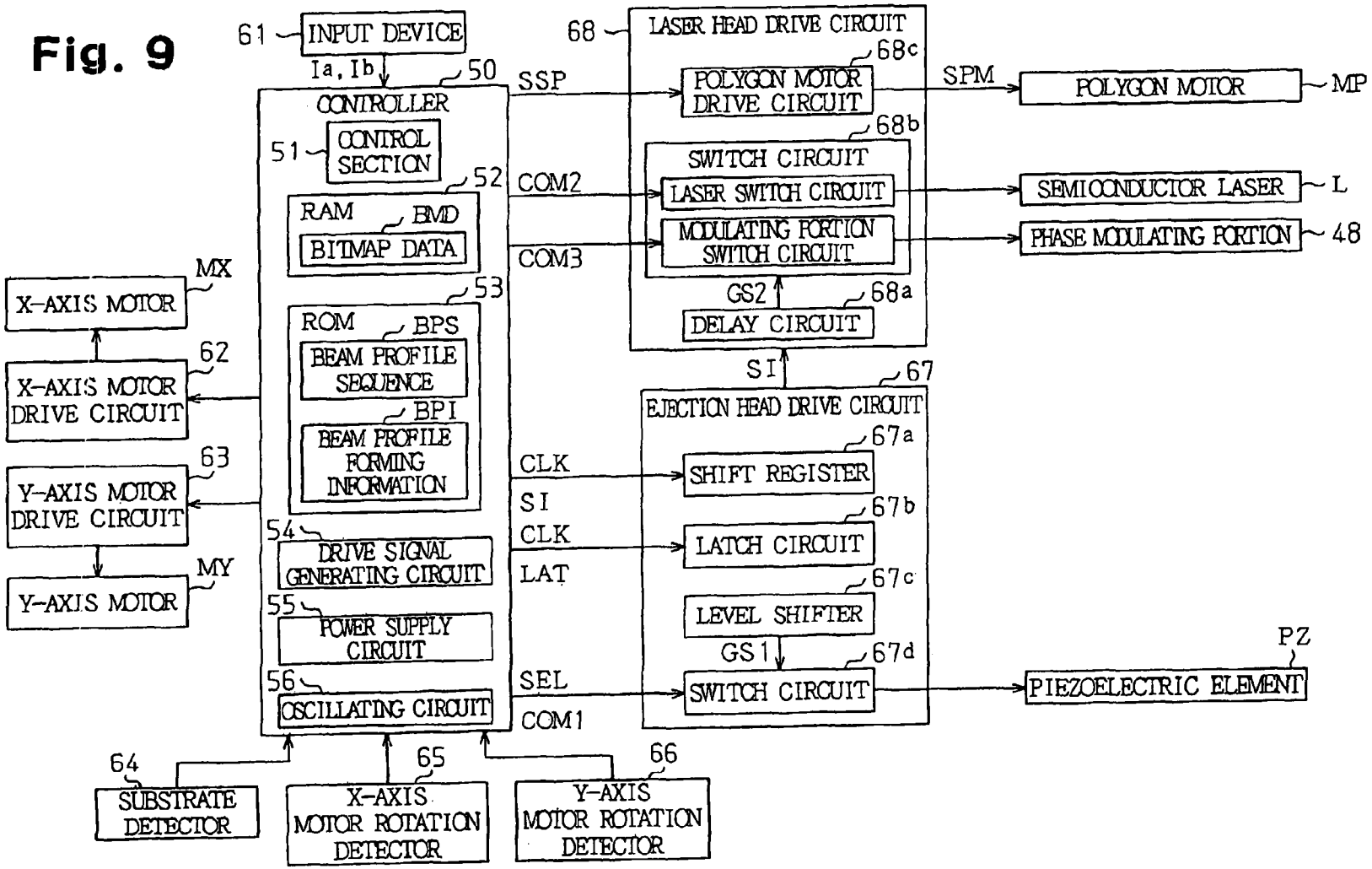
FIG. 9 is a block circuit diagram showing the electric configuration of the liquid droplet ejection apparatus of FIG. 4.

In FIG. 9, a controller 50 comprises a control section 51 consisting of a CPU or the like, a RAM 52 consisting of a DRAM and an SRAM, and a ROM 53 storing various kinds of control programs and various kinds of data. The controller 50 comprises a drive signal generating circuit 54 generating piezoelectric element drive signal COM1 and the phase modulating portion drive signal COM3, a power supply circuit 55 generating the laser drive signal COM2, and an oscillating circuit 56 or the like generating a clock signal CLK for synchronizing various kinds of signals. The control section 51, the RAM 52, the ROM 53, the drive signal generating circuit 54, the power supply circuit 55 and the oscillating circuit 56 are connected to the controller 50 via a bus (not shown).

Specifically, the ROM 53 stores a plurality of pieces of beam profile forming information BPI (e.g. first and second agitation profile forming information BPI1 and BPI2) and a plurality of beam profile sequences BPS (e.g. planarization sequence in this embodiment).

Each piece of beam profile forming information BPI is information for driving and controlling the phase modulating portion 48 for forming a corresponding beam profile, and is information for generating the phase modulating portion drive signal COM3.

Each beam profile sequence BPS is information for continuously forming different beam profiles based on the different beam profile forming information BPI, and is information for generating the phase modulating portion drive signal COM3.

Each beam profile sequence BPS has data (thickness distribution data Ib) about the thickness distribution of the color film 24 formed by the laser beam of a corresponding sequence. Each beam profile sequence BPS has information (profile identification information) making it possible to identify a plurality of pieces of beam profile forming information BPI that are used in the sequences. In each beam profile sequence BPS, data (forming time data) about the time for forming each beam profile (time for driving and controlling the phase modulating portion 48) and data (forming order data) about the order for forming each beam profile are set in correspondence with the profile identification information.

For example, the planarization sequence in this embodiment has numerical data in which unevenness in thickness of the color film 24 is equal to or less than a predetermined numerical value as thickness distribution data Ib. The planarization sequence has profile identification information corresponding to the first agitation profile forming information BPI1, the second agitation profile forming information BPI2 and the drying profile. In the planarization sequence, forming time data for the first agitation time, the second agitation time and the drying time is set in correspondence with identification information for the first agitation profile forming information BPI1, the second agitation profile forming information BPI2 and the drying profile. In the planarization sequence, forming order data for forming beam profiles in the order of the first agitation profile BP1, the second agitation profile BP2 and the drying profile is set in correspondence with the first agitation profile forming information BPI1, the second agitation profile forming information BPI2 and the drying profile.

An input device 61 is connected to the controller 50.

The input device 61 has operation switches such as a start switch and a stop switch, and outputs operation signals by operations of the switches to the controller 50 (control section 51). The input device 61 outputs information for forming a droplet FD corresponding to the color film 24 to a controller 50 as dot formation data Ia. The input device 61 outputs information about a thickness distribution of the color film 24 to the controller 50 as thickness distribution data Ib.

The controller 50 moves the substrate stage 33 to perform an operation of conveying the color filter substrate and drives each piezoelectric element PZ of the ejection head FH to perform a liquid droplet ejection operation in accordance with dot formation data Ia and thickness distribution data Ib from the input device 61 and a control program (e.g. color filter production program) stored in the ROM 53 or the like. The controller 50 performs an agitation and drying operation of driving the laser head LH to agitate and dry the droplet FD.

Specifically, the control section 51 subjects the dot formation data Ia from the input device 61 to predetermined development processing, generates bitmap data BMD indicating whether the droplet FD is ejected at a position on a two-dimensional dot formation plane (color film forming surface 21*a*), and stores the generated bitmap data BMD in the RAM. The bitmap data BMD specifies ON or OFF of the piezoelectric element PZ (whether the droplet FD is ejected or not) according to the value of each bit (0 or 1).

The control section 51 subjects the dot formation data Ia from the input device 61 to development processing different from the development processing for the bitmap data BMD, generates waveform data of the piezoelectric element drive signal COM1 appropriate to a drawing condition and outputs the generated waveform data to the drive signal generating circuit 54. The drive signal generating circuit 54 stores the waveform data from the control section 51 in a waveform memory (not shown). The drive signal generating circuit 54 subjects the stored waveform data to digital/analog conversion to amplify a waveform signal of an analog signal, and thereby generates the corresponding piezoelectric element drive signal COM1.

The control section 51 synchronizes the bitmap data BMD with a clock signal CLK generated by the oscillating circuit 56, and sequentially serially transfers data for each scan (one forward movement or backward movement of the substrate stage 33) as ejection control data SI to an ejection head drive circuit 67 (shift register 67*a*) described later. The control section 51 outputs a latch signal LAT for latching the serially transferred ejection control data SI for one scan.

The control section 51 synchronizes the piezoelectric element drive signal COM1 with the clock signal CLK generated by the oscillating circuit 56 and outputs the piezoelectric element drive signal COM1 to the ejection head drive circuit 67 (switch circuit 67*d*) described later. The control section 51 is configured to output to the ejection head drive circuit 67 (switch circuit 67*d*) a selection signal SEL for selecting the piezoelectric element drive signal COM1 and apply to each piezoelectric element PZ the piezoelectric element drive signal COM1 corresponding to the selection signal SEL.

The control section 51 searches thickness distribution data Ib of the beam profile sequence BPS stored in the ROM 53 referring to thickness distribution data Ib from the input device 61, and determines the beams profile sequence BPS of the thickness distribution data Ib corresponding to the thickness distribution data Ib from the input device 61. The control section 51 extracts beam profile forming information BPI corresponding to each piece of profile identification information from the ROM 53 based on profile identification information of the determined beam profile sequence BPS. The control section 51 generates the corresponding phase modulating portion drive signal COM3 based on each piece of beam profile forming information BPI extracted, and forming time data and forming order data of the determined beam profile sequence BPS.

The control section 51 synchronizes the generated phase modulating portion drive signal COM3 with the clock signal CLK generated by the oscillating circuit 56 and outputs the phase modulating portion drive signal COM3 to a laser head drive circuit 68 (switch circuit 68*b*) described later.

The control section 51 outputs the laser drive signal COM2 to the laser head drive circuit 68 (switch circuit 68*b*).

As shown in FIG. 9, an x-axis motor drive circuit 62 is connected to the controller 50, and an x-axis motor drive and control signal is output to the x-axis motor drive circuit 62. The x-axis motor drive circuit 62 rotates an x-axis motor MX in a forward or reverse direction, thereby causing the carriage 39 to move forward and backward, in response to the x-axis motor drive and control signal from controller 50. For example, when the x-axis motor MX is rotated in the forward direction, the carriage 39 moves in direction X, and when the x-axis motor MX is rotated in the reverse direction, the carriage 39 moves in a direction opposite to direction X.

A y-axis motor drive circuit 63 is connected to the controller 50, and a y-axis motor drive and control signal is output to the y-axis motor drive circuit 63. The y-axis motor drive circuit 63 rotates a y-axis motor MY in a forward or reverse direction, thereby causing the substrate stage 33 to move forward and backward, in response to the y-axis motor drive and control signal from the controller 50. For example, when the y-axis motor MY is rotated in the forward direction, the substrate stage 33 moves in direction Y, and when the y-axis motor is reversely moved, the substrate stage 33 moves in a direction opposite to direction Y.

A substrate detector 64 is connected to the controller 50. The substrate detector 64 detects an end edge of the color filter substrate 10, and the detection result is used when calculating a position of the color filter 10 (color film forming area 23) passing immediately below the ejection head FH (nozzle hole N) by the controller 50.

An x-axis motor rotation detector 65 is connected to the controller 50, and a detection signal from the x-axis motor rotation detector 65 is input to the controller 50. The controller 50 detects the direction and amount of rotation of the x-axis motor MX based on the detection signal from the x-axis motor rotation detector 65, and calculates the amount and direction of movement of the carriage 39 in direction X.

A y-axis motor rotation detector 66 is connected to the controller 50, and a detection signal from the y-axis motor rotation detector 66 is input to the controller 50. The controller 50 detects the direction and amount of rotation of the y-axis motor MY based on the detection signal from the y-axis motor rotation detector 66, and calculates the direction and amount of movement of the substrate stage 33 (color film forming area 23) in direction Y.

An ejection head drive circuit 67 and a laser head drive circuit 68 are connected to the controller 50.

The ejection head drive circuit 67 comprises a shift register 67*a*, a latch circuit 67*b*, a level shifter 67*c* and a switch circuit 67*d*. The shift register 67*a* subjects ejection control data SI from the controller 50 synchronized with the clock signal CLK to serial/parallel conversion associated with each piezoelectric element PZ. The latch circuit 67*b* latches the ejection control data SI subjected to parallel conversion by the shift register 67*a* in synchronization with the latch signal LAT from the controller 50, and sequentially outputs the latched ejection control data SI to the level shifter 67*c* and a delay circuit 68*a* of the laser head drive circuit 68 described later in a predetermined cycle synchronized with the clock signal CLK. The level shifter 67*c* boosts the ejection control data SI latched by the latch circuit 67*b* to a voltage to drive the switch circuit 67*d* to generate a first switching signal GS1 corresponding to each piezoelectric element PZ.

The switch circuit 67*d* comprises switch elements (not shown) corresponding to the piezoelectric elements PZ. The piezoelectric element drive signal COM1 corresponding to the selection signal SEL is input to the input side of each switch element, and the corresponding piezoelectric element PZ is connected to the output side. The corresponding first switching signal GS1 from the level shifter 67*c* is input to each switch element of the switch circuit 67*d*, and whether the piezoelectric drive signal COM1 is supplied to the corresponding piezoelectric element PZ is determined according to each first switching signal.

That is, the liquid droplet ejection apparatus 30 of this embodiment applies the piezoelectric element drive signal COM1 generated by the drive signal generating circuit 54 to each corresponding piezoelectric element PZ and controls the application of the piezoelectric element drive signal COM1 by the ejection control data SI (first switching signal GS1) from the controller 50. When the piezoelectric element drive signal COM1 is applied to the piezoelectric element PZ corresponding to the closed switch element based on the ejection control data SI, microdroplets Fb (droplets FD) are ejected from the nozzle hole N corresponding to the piezoelectric element PZ.

Figure 10:
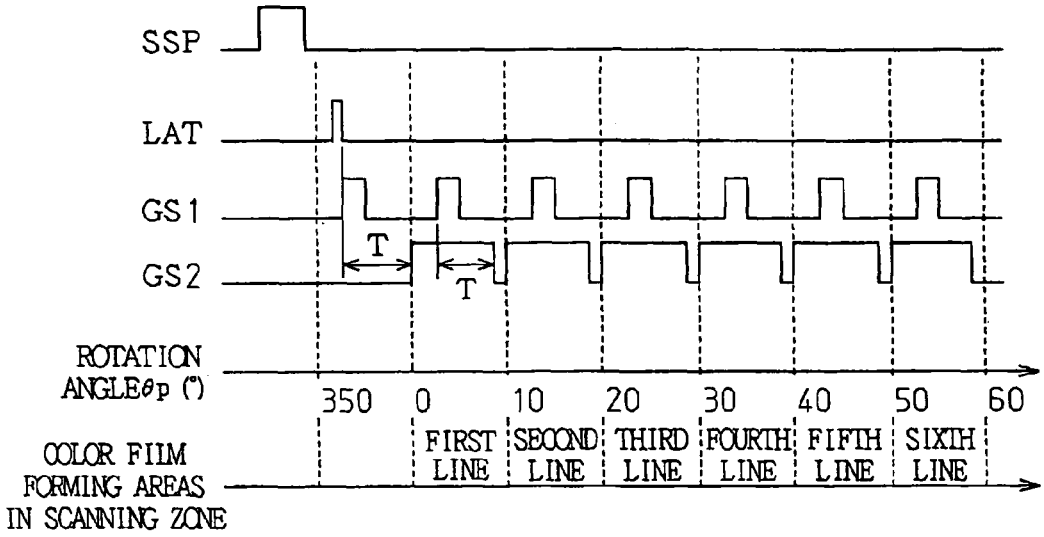
FIG. 10 is a timing chart for explaining operational timing of a piezoelectric element and a semiconductor laser.

FIG. 10 is a timing chart showing pulse waveforms of the aforementioned latch signal and first switching signal GS1 and a second switching signal GS2 described later, and rotation angles θp of the polygon motor MP.

As shown in FIG. 10, in response to a falling edge of the latch signal LAT input to the ejection head drive circuit 67, the first switching signal GS1 is generated based on the latched ejection control data SI, and in response to a rising edge of the first switching signal GS1, the piezoelectric element drive signal COM1 is supplied to the corresponding piezoelectric element PZ. By expansion and contraction motion of the piezoelectric element PZ based on the piezoelectric element drive signal COM1, microdroplets Fb (droplets FD) are ejected from the corresponding nozzle hole N. In response to a falling edge of the first switching signal GS1, the operation of ejecting droplets FD by drive of the piezoelectric element PZ is ended.

The laser head drive circuit 68 comprises a delay circuit 68*a*, a switch circuit 68*b* and a polygon motor drive circuit 68*c*.

The delay circuit 68*a* generates a pulse signal (second switching signal GS2) of a predetermined time range in which the ejection control data SI latched by the latch circuit 67*b* is delayed by predetermined time (the standby time T), and outputs the generated second switching signal GS2 to the switch circuit 68*b* (laser switch circuit and modulating portion switch circuit).

The switch circuit 68*b* comprises a laser switch circuit and a modulating portion switch circuit. The laser switch circuit comprises switch elements (not shown) corresponding to the semiconductor lasers L. The laser drive signal COM2 generated by the power supply circuit 55 is input to the input side of each switch element, and each corresponding semiconductor laser L is connected to the output side. When the second switching signal GS2 from the delay circuit 68*a* is input to each switch element of the laser switch circuit, each switch element supplies the laser drive signal COM2 to the corresponding semiconductor laser L.

That is, the liquid droplet ejection apparatus 30 of this embodiment applies the laser drive signal COM2 generated by the power supply circuit 55 equally to each corresponding semiconductor laser L, and controls the application of the laser drive signal COM2 by the ejection control data SI (second switching signal GS2) from the controller 50 (ejection head drive circuit 67). When the laser drive signal COM2 is supplied to the semiconductor laser L corresponding to the closed switch element based on the ejection control data SI, the laser beam B is emitted from the corresponding semiconductor laser L.

The modulating portion switch circuit comprises switch elements (not shown) corresponding to the phase modulating portions 48. The phase modulating portion drive signal COM3 generated by the control section 51 is input to the input side of each switch element, and each corresponding phase modulating portion 48 is connected to the output side. When the second switching signal GS2 from the delay circuit 68*a* is input to each switch element of the modulating portion switch circuit, each switch element supplies the phase modulating portion drive signal COM3 to the corresponding phase modulating portion 48.

That is, the liquid droplet ejection apparatus 30 of this embodiment applies the phase modulating portion drive signal COM3 generated by the controller 50 (drive signal generating circuit 54) equally to each corresponding phase modulating portion 48, and controls the application of the phase modulating portion drive signal COM3 by the ejection control data SI (second switching signal GS2) from the controller 50 (ejection head drive circuit 67). When the phase modulating portion drive signal COM3 is supplied to the phase modulating portion 48 corresponding to the closed switch element based on the ejection control data SI, the corresponding phase modulating portion 48 subjects the laser beam B to phase modulation based on the beam profile sequence BPS.

The polygon motor drive circuit 68*c* receives a polygon motor drive start signal SSP from the controller 50 to generate a polygon motor drive control signal SPM, and outputs the generated signal SPM to the polygon motor MP to rotate the polygon motor MP. The controller 50 outputs the polygon motor drive start signal SSP to start the rotation of the polygon motor MP, based on a detection signal from the substrate detector 64. Specifically, when the front end of the first-line color film forming area 23 with respect to direction Y is situated at the radiation start position Pe1, the controller 50 outputs the polygon motor drive start signal SSP in predetermined timing in which the rotation angle θp of the polygon mirror 49 is zero degrees, to the laser head drive circuit 68.

As shown in FIG. 10, when the standby time T elapses after a rising edge of the first switching signal GS1 (ejection operation is started), the second switching signal GS2 is generated by the delay circuit 68*a*, and the second switching signal GS2 is supplied to the switch circuit 68*b* (laser switch circuit and modulating portion switch circuit). In response to a rise of the second switching signal GS2, the laser drive signal COM2 is supplied to the corresponding semiconductor laser L, and the laser beam B is emitted from the corresponding semiconductor laser L. At the same time, in response to a rising edge of the second switching signal GS2, the phase modulating portion drive signal COM3 is supplied to the corresponding phase modulating portion 48, and the corresponding phase modulating portion 48 starts subjecting the laser beam B to phase modulation based on the beam profile sequence BPS determined by the control section 51. That is, the first agitation profile BP1, the second agitation profile BP2 and the drying profile are sequentially formed within the scanning time.

As shown in FIG. 10, in response to a rising edge of the second switching signal GS2, the rotation angle θp of the rotating polygon mirror 49 is zero degrees. Therefore, the laser beam B of the first agitation profile BP1 is applied to the droplet FD situated at the radiation start position Pe1. When the droplet FD is continuously transferred into a scanning zone Ls, the laser beams B of the first agitation profile BP1 and the second agitation profile BP2 and the drying profile with the radiating position made stationary relative to the droplet FD on the corresponding color film forming area 23 by the scanning of the laser beams B are sequentially applied to the droplet FD within the scanning time (=scanning width Ly2/transport speed Vy).

In response to a falling edge of the second switching signal GS2, emission of the laser beam B from the semiconductor laser L is stopped to end the operation of processing the first-line droplet FD.

Subsequently, when the standby time T elapses after the ejection operation in the second line is started, the first-line color film forming area 23 leaves the scanning zone Ls and the front end of the following second-line color film forming area 23 in direction Y enters the scanning zone Ls. The second switching signal GS2 is generated again in the laser head drive circuit 68 (delay circuit 68*a*), and in response to a rising edge of the second switching signal GS2, the laser beams B of the first agitation profile BP1 are started to be applied at a time from the corresponding radiation ports 47.

At this time, the rotation angle θp of the rotating polygon mirror 49 is ten degrees as shown in FIG. 10. Thus, the laser beam B of the first agitation profile BP1 reflected and deflected at the reflection surface M is applied to the second-line droplet FD situated at the radiation start position Pe1.

Subsequently, similarly, each time the following color film forming area 23 passes through the scanning zone Ls with the droplet FD deposited thereon, the laser beams B of the first agitation profile BP1, the second agitation profile BP2 and the drying profile with the radiating position made stationary relative to the droplet FD are sequentially applied to the corresponding droplets FD.

A method for manufacturing the color filter substrate 10 (color film 24) using the liquid droplet ejection apparatus 30 will now be described.

First, the color filter substrate 10 is fixedly placed on the substrate stage 33 situated at a proceed position as shown in FIG. 4. At this time, the front edge of the color filter substrate 10 with respect to direction Y is situated rearward of the guide member 36 with respect to direction Y. The carriage 39 (ejection head FH) is set at a position where the corresponding color film forming area 23 passes immediately below each nozzle hole N when the color filter substrate 10 moves in direction Y.

In this state, the controller 50 drives and controls the y axis motor MY to convey the color filter substrate 10 in direction Y at a transport speed Vy via the substrate stage 33. When the substrate detector 64 detects the front edge of the color filter substrate 10 with respect to direction Y, the controller 50 generated the polygon motor drive start signal SSP in the aforementioned predetermined timing. In response to a rising edge of the polygon motor drive start signal SSP, the polygon motor drive and control signal SPM is generated by the polygon motor drive circuit 68*c* and the polygon mirror 49 is rotated in the direction R.

Consequently, the rotation angle θp of the polygon mirror 49 is zero degrees when the front edge of the first-line color film forming area 23 with respect to direction Y is situated at the radiation start position Pe1.

The controller 50 determines whether the target ejecting position Pa of the first-line color film forming area 23 has reached a position immediately below the corresponding nozzle hole N based on the detection signal from the y-axis motor rotation detector 66.

In the meantime, the controller 50 searches thickness distribution data Ib of the beam profile sequence BPS stored in the ROM 53 in accordance with a color filter production program. The controller 50 determines beam profile sequences BPS (planarization sequences) of the thickness distribution data Ib (data showing that the uniformity of the thickness of the color film 24 is sufficiently high) from the input device 61 and corresponding thickness distribution data Ib. The controller 50 reads each piece of beam profile forming information BPI (first agitation profile forming information BPI1, second agitation profile forming information BPI2 and the drying profile) corresponding to each piece of profile identification information based on profile identification information of the determined planarization sequence. Subsequently, the controller 50 generates the corresponding phase modulating drive signal COM3 based on forming time data (first agitation time, second agitation time, and drying time) and forming order data of the planarization sequence. The controller 50 outputs the generated phase modulating portion drive signal COM3 to the laser head drive circuit 86.

In the meantime, the controller 50 outputs the laser drive signal COM2 generated in the power supply circuit 55 to the laser head drive circuit 68.

In the meantime, the controller 50 to the ejection head drive circuit 67 the ejection control head SI based on the bitmap data BMD stored in the RAM 52 and the piezoelectric element drive signal COM1 generated in the drive signal generating circuit 54 in accordance with the color filter production program.

The controller 50 waits for timing for outputting the latch signal LAT to the ejection head drive circuit 67.

When the target ejecting position Pa of the first-line color film forming area 23 reaches a position immediately below the corresponding nozzle hole N, the controller 50 outputs the latch signal LAT to the ejection head drive circuit 67. When receiving the latch signal LAT from the controller 50, the ejection head drive circuit 67 generates the first switching signal GS1 based on the ejection control data SI, and outputs the first switching signal GS1 to the switch circuit 67*d*. The piezoelectric element drive signal COM1 corresponding to the selection signal SEL is supplied to the piezoelectric element PZ corresponding to the closed switch element, and microdroplets Fb corresponding to the piezoelectric element drive signal COM1 are ejected at a time from corresponding nozzle holes N. The ejected microdroplets Fb are deposited into the corresponding first-line color film forming area 23 at a time to form the droplet FD.

When the latch signal LAT is input to the ejection head drive circuit 67, the laser head drive circuit 68 (delay circuit 68*a*) receives the ejection control data SI from the latch circuit 67*b* to start generation of the second switching signal GS2.

The laser head drive circuit 68 waits for timing for outputting the second switching signal GS2 to the switch circuit 68*b* (laser switch circuit and modulating portion switch circuit).

When the standby time T elapses after the piezoelectric element PZ starts the ejection operation, i.e. the ejection head drive circuit 67 outputs the first switching signal GS1, the droplet FD on first-line color film forming area 23 starts entering the scanning zone Ls, and the laser head drive circuit 68 outputs the second switching signal GS2 to the laser switch circuit and the modulating portion switch circuit.

The laser switch circuit supplies the common laser drive signal COM2 to the corresponding semiconductor laser L and emits the laser beams B at a time from the corresponding laser L. At the same time, the modulating portion switch circuit outputs the common phase modulating portion drive signal COM3 to the corresponding phase modulation portion 48, and drives and controls the phase modulating portion 48 based on the phase modulating portion drive signal COM3.

Consequently, the laser beams B of the first agitation profile BP1, the second agitation profile BP2 and the drying profile with the radiating position made stationary relative to the droplet FD entering the scanning zone Ls are sequentially and successively applied to the droplet FD. In response to a falling edge of the second switching signal GS2, emission of the laser beam B from the semiconductor laser L is stopped, and the agitation and drying operation for the first-line droplet FD is ended.

Consequently, the color film 24 having a uniform thickness is formed in the corresponding color film forming area 23.

Subsequently, similarly, each time the following color film forming area 23 in each line passes through the scanning zone Ls with the droplet FD deposited thereon, the laser beams B of the first agitation profile BP1, the second agitation profile BP2 and the drying profile with the radiating position made stationary relative to the corresponding droplet FD are sequentially and successively applied to the droplet FD to form the color film 24 having a uniform thickness.

When the color films 24 are formed on all the color film forming areas 23, the controller 50 controls the y-axis motor MY to place the substrate stage 33 (color filter substrate 10) at a proceed position.

Advantages of this embodiment configured in a manner described above will now be described below.

(1) According to the aforementioned embodiment, the first and second agitation profiles BP1 and BP2 are formed with a maximum value of radiation intensity for sufficiently inhibiting evaporation of the color film forming material and the dispersion medium and inducing thermal convection of the color film forming material and the dispersion medium in the corresponding droplet FD. As a result, the color film forming material in the droplet FD can be made to flow to regions corresponding to peak positions of the first and second agitation profiles BP1 and BP2, and the color films 24 can be controlled to have thickness distributions corresponding to the first and second agitation profiles BP1 and BP2.

(2) According to the aforementioned embodiment, the first agitation profile BP1 having a sharp peak only in a rear portion of the color film forming area 23 with respec to direction Y and the second agitation profile BP2 having a sharp peak only in a front portion of the color film forming area 23 with respect to direction Y are successively formed. The laser beam B of the first agitation profile BP1 and the laser beam B of the second agitation profile BP2 are successively applied. As a result, the color film forming material in the droplet FD can be made to flow (agitated) to uniformly disperse the color film forming material in the color film forming area 23. Thus, the color film 24 having a uniform thickness can be formed in the color film forming area 23.

(3) According to the aforementioned embodiment, the beam profile sequence BPS comprises thickness distribution data, and the controller 50 determines the beam profile sequence BPS (planarization sequence) corresponding to a desired uniform thickness distribution. As a result, a beam profile corresponding to a desired thickness distribution can reliably be formed, and the thickness of the color film 24 can be made uniform more reliably.

(4) According to the aforementioned embodiment, the laser beams B of the first agitation profile BP1 and the second agitation profile BP2 with the radiating position made stationary relative to the droplet FD are applied to the droplet. As a result, the switch can be made between the first agitation profile BP1 and the second agitation profile BP2 in desired timing without being restricted by the transport direction of the droplet FD, and the like.

The aforementioned embodiment may be modified as follows.

In the embodiment described above, energy is embodied in the form of laser beams B, but the present invention is not limited thereto, and for example, electron beams and ion beams may be used, and any type of energy causing the color film forming material (structure forming material) to flow may be used.

In the embodiment described above, the structure profile is embodied in the form of a thickness distribution of the color film 24, but the present invention is not limited thereto, and for example, the color film 24 may be formed with a plurality of constituent materials, and the structure profile may be embodied in the form of a concentration distribution of each constituent material. Alternatively, the structure profile may be embodied in the form of a shape distribution of the color film 24

In the embodiment described above, the energy profile is embodied in the form of a distribution of the radiation intensity. The present invention is not limited thereto, and the energy profile may be a distribution of the shape of beam spots or a distribution of the wavelength.

In the embodiment described above, the distribution of the color film forming material in the droplet FD is made uniform by the first agitation profile BP1 having a sharp peak of the radiation intensity only in a rear portion with respect to direction Y of the color film forming area 23 and the second agitation profile BP2 having a sharp peak of the radiation intensity only in a front portion with respect to direction Y.

Figure 11A:
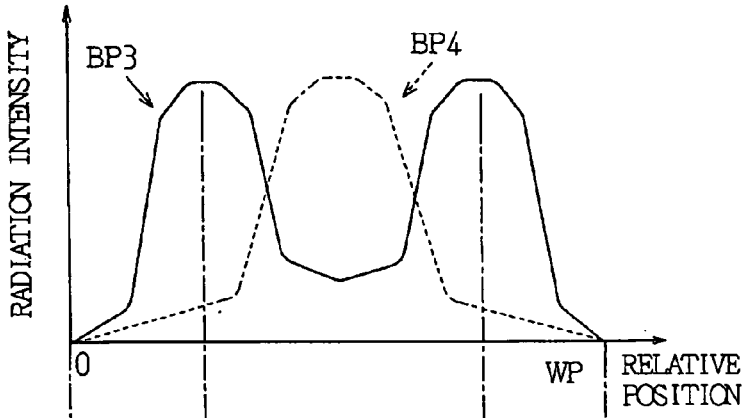
FIGS. 11A, 11B, and 11C are diagram for explaining a beam profile for a color film forming area according to a modified embodiment.
Figure 11B:
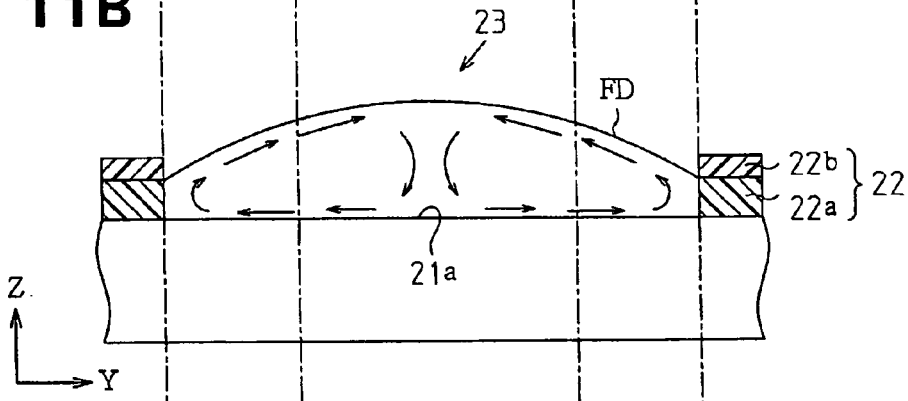
Figure 11C:
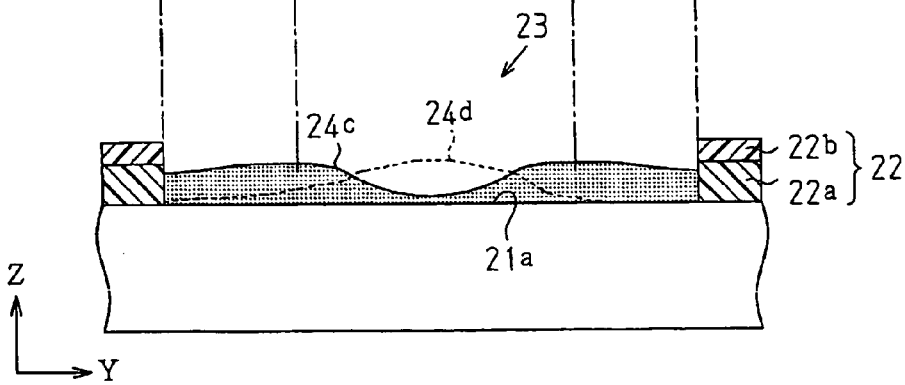

The present invention is not limited thereto, and for example, a third agitation profile BP3 having a pair of split sharp peaks in front and rear portions with respect to direction Y of the color film forming area 23 may be formed as shown with the solid line in FIG. 11A, so that the color film forming material in the droplet FD is first split into a front portion and a rear portion with respect to direction Y as shown with the solid lines in FIGS. 11B and 11C. Then, a fourth agitation profile BP4 having a sharp peak in a central portion of the color film forming area 23 with respect to direction Y may be formed as shown with the dashed line in FIG. 11A, so that the color film forming material in the droplet FD flows toward the central portion of the color film forming area 23 as shown with the dashed line in FIG. 11C.

In the embodiment described above, the beam profile sequence is formed as a planarization sequence for making the thickness of the color film 24 uniform. The present invention is not limited thereto, and the beam profile sequence may be a sequence for making the color film 24 have a thickness increased at one end of the color film forming area 23, and may be any sequence corresponding to a desired structure profile.

In the embodiment described above, the beam profile sequence is formed according to the beam profile forming information BPI, the time for forming each beam profile, and the order for forming each beam profile. The present invention is not limited thereto, and for example, a configuration in which scanning information for scanning each beam profile in a predetermined direction is set in the beam profile sequence, and the beam profile is scanned in a desired direction in a predetermined cycle may be employed. According to this configuration, the beam profile can be controlled with higher accuracy and a controllable range of the structure profile can further be expanded.

In the embodiment described above, the energy profile information is embodied in the form of a beam profile sequence. The present invention is not limited thereto, and for example, the energy profile information may be embodied in the form of beam profile forming information BPI (first agitation profile forming information BPI1 and second agitation profile forming information BPI2), and a structure such as a color film is controlled to be a desired structure profile by a single beam profile.

In the embodiment described above, an energy profile information determining section is embodied in the form of the control section 51, and thickness distribution data Ib possessed by each beam profile sequence BPS is matched with desired thickness distribution data Ib to determine the beam profile sequence BPS.

The present invention is not limited thereto, and for example, a configuration in which a predetermined operation for generating the beam profile sequence BPS (beam profile information) from thickness distribution data Ib (structure profile) beforehand based on tests and the like, and the control section 51 carries out the predetermined operation for desired thickness distribution data Ib (structure profile) to generate the beam profile sequence BPS (energy profile information) may be employed.

According to this modified embodiment, energy file information corresponding to a desired structure profile can reliably be acquired.

In the embodiment described above, the position of irradiation of the laser beam B is made stationary relative to the droplet FD by the energy beam scanning section. The present invention is not limited thereto, and for example, a configuration in which the position of irradiation of the laser beam B is fixed, and each droplet FD is transferred to the position of irradiation of the laser beam B and irradiated with the laser beam B of the corresponding beam profile in a state of being stopped at the radiating position may be employed. According to this configuration, the laser beam B can be applied for a long time without being restricted by the scanning time.

In the embodiment described above, the liquid droplet ejection portion is embodied in the form of the ejection head FH, but the present invention is not limited thereto, and for example, a configuration in which a liquid is ejected by a liquid droplet ejection portion such as a dispenser may be employed.

In the embodiment described above, the energy beam scanning section is embodied in the form of an optical system having the polygon mirror 49. The present invention is not limited thereto, and the energy beam scanning section may be formed with a galvanometer mirror or the like, and any scanning section for making the position of irradiation of the laser beam B stationary relative to the droplet FD.

In the embodiment described above, an energy outputting section is embodied in the form of the semiconductor laser L, but the present invention is not limited thereto, and the energy outputting section may be a carbon gas laser, a YAG laser, a LED or electron beam laser, or the like.

In the embodiment described above, a beam profile is formed using the electrically or mechanically driven phase modulating portion 48. The present invention is not limited thereto, and the beam profile (energy profile) may be formed using, for example, a diffractive element, a mask, a diverging element or the like, and any means capable of forming a desired energy profile in the color film forming area 23 may be used.

In the embodiment described above, the color film forming area 23 is embodied in the form of substantially a square, but it is not limited to this shape, and the color film forming area 23 may be, for example, elliptical or polygonal.

In the embodiment described above, semiconductor lasers L is provided in a number equivalent to the number of nozzle holes N, but the present invention is not limited thereto, and an optical system in which a single laser beam B emitted from a laser beam source is split by a diverging element such as a diffractive element may be used.

In the embodiment described above, the liquid droplet ejection apparatus 30 is used for forming the color films 24 on the color filter substrate 10. However, for example, an insulating film or a metal wiring pattern may be formed by the droplets FD, which are ejected by the liquid droplet ejection apparatus 30. In this case, controllability of the structure profile of the insulating film or the metal wiring pattern can be improved as in the embodiment described above.

In the embodiment described above, the electro-optic device is embodied as the liquid crystal display 1. The multiple color films 24 are formed in the liquid crystal display 1 in accordance with a certain pattern. However, the electro-optic device formed according to the present invention may be an electroluminescence display including light emission elements that are provided in accordance with a certain pattern. In this case, the droplet FD contains material for forming the light emission elements. The droplet FD is ejected onto a light emission element forming area, thus providing the corresponding light emission element. In this configuration, controllability of the structure profile of the light emission element can be improved.

In the embodiment described above, the electro-optic device is embodied as the liquid crystal display 1, which includes the multiple color films 24 that are formed in accordance with a certain pattern. However, the electro-optic device formed according to the present invention may be a display having a field effect type device (an FED or an SED), in which an insulating film or a metal wiring is provided in accordance with a certain pattern. The field effect type device has a flat electron emission element and emits light from a fluorescent substance using electrons emitted by the electron emission element.

What is claimed is:

1. A liquid droplet ejection apparatus comprising:

a liquid droplet ejection portion that ejects a liquid droplet containing a structure forming material onto a substrate; and drying means that dries the droplet on the substrate, thereby forming a structure made of the structure forming material, wherein the drying means includes:

an energy outputting section that outputs energy onto the droplet on the substrate, thereby causing the structure forming material in the droplet to flow;

an energy profile controlling section controlling, based on a drive and control signal, an energy profile of the energy output by the energy outputting section; and a controller that generates the drive and control signal, wherein the controller includes a CPU and ROM, wherein the CPU searches for a beam profile sequence corresponding to thickness distribution data of the structure to be formed from among a plurality of beam profile sequences stored in the ROM, wherein the CPU searches for, based on profile identification information of the beam profile sequence, a piece of beam profile forming information corresponding to the profile identification information from among a plurality of pieces of beam profile forming information stored in the ROM, the specific piece of beam profile forming information, and wherein the CPU generates the drive and control signal based on the beam profile sequence and the piece of beam profile forming information.

2. The apparatus according to claim 1, wherein each beam profile sequence is a sequence for continuously reproducing different pieces of beam profile forming information.

3. The apparatus according to claim 1, wherein the energy profile controlling section includes a plurality of diffractive elements that diffract the energy output by the energy outputting section, thereby controlling the energy profile of the energy.

4. The apparatus according to claim 1, wherein the energy profile controlling section includes a spatial light modulator that modulates the energy output by the energy outputting section, thereby controlling the energy profile of the energy.

5. The apparatus according to claim 1, wherein the energy profile controlling section includes an energy scanning section that scans the energy such that the droplet on the substrate is maintained stationary relative to a radiating position of the energy.

6. The apparatus according to claim 1, wherein the energy is a light beam.

7. The apparatus according to claim 1, wherein the energy is coherent light.

8. The apparatus according to claim 1, wherein the structure is a film.

* * * * *